US008802993B2

(12) United States Patent
Törnkvist et al.

(10) Patent No.: US 8,802,993 B2
(45) Date of Patent: Aug. 12, 2014

(54) HIGH VOLTAGE BUSHING

(75) Inventors: Christer Törnkvist, Strömsholm (SE); Uno Gäfvert, Västerås (SE)

(73) Assignee: ABB Research Ltd., Zürich (CH)

( * ) Notice: Subject to any disclaimer, the term of this patent is extended or adjusted under 35 U.S.C. 154(b) by 643 days.

(21) Appl. No.: 12/439,539

(22) PCT Filed: Aug. 30, 2007

(86) PCT No.: PCT/SE2007/050600

§ 371 (c)(1),
(2), (4) Date: Mar. 1, 2009

(87) PCT Pub. No.: WO2008/027008

PCT Pub. Date: Mar. 6, 2008

(65) Prior Publication Data

US 2009/0260843 A1 Oct. 22, 2009

(30) Foreign Application Priority Data

Aug. 31, 2006 (SE) ..... 0601787

(51) Int. Cl.
*H01B 17/58* (2006.01)

(52) U.S. Cl.
USPC ..... 174/152 G; 174/152 R

(58) Field of Classification Search
USPC ..... 174/650, 152 G, 153 G, 152 R, 135, 174/137 R, 152 E
See application file for complete search history.

(56) References Cited

U.S. PATENT DOCUMENTS

| | | | | |
|---|---|---|---|---|
| 3,066,180 | A | 11/1962 | Virsbert et al. | |
| 3,659,033 | A | 4/1972 | Grimmer | |
| 3,659,244 | A * | 4/1972 | McKeithan et al. | 337/202 |
| 3,911,937 | A * | 10/1975 | Sletten et al. | 134/1 |
| 4,031,311 | A * | 6/1977 | Mazanek | 174/31 R |
| 4,166,193 | A * | 8/1979 | Schmidt et al. | 174/28 |
| 4,272,642 | A * | 6/1981 | Classon | 174/31 R |
| 4,296,274 | A * | 10/1981 | Cookson | 174/142 |
| 6,218,627 | B1 * | 4/2001 | Shindo et al. | 174/167 |
| 6,346,677 | B1 * | 2/2002 | Guillemette et al. | 174/142 |
| 6,452,109 | B1 * | 9/2002 | Koch et al. | 174/152 R |
| 6,924,438 | B2 * | 8/2005 | Geibel | 174/152 R |
| 2004/0145853 | A1 * | 7/2004 | Sekoguchi et al. | 361/225 |
| 2006/0157269 | A1 * | 7/2006 | Kopp et al. | 174/142 |

FOREIGN PATENT DOCUMENTS

| | | |
|---|---|---|
| EP | 0109836 | 5/1984 |
| EP | 0429843 | 6/1991 |
| EP | 0795877 | 9/1997 |
| GB | 880275 A | 10/1961 |
| WO | WO-2005/006355 A1 | 2/2005 |

OTHER PUBLICATIONS

Polyethylene Terephthalate Material Information From www.goodfellow.com.*

(Continued)

*Primary Examiner* — Burton Mullins
*Assistant Examiner* — Eric Johnson
(74) *Attorney, Agent, or Firm* — Venable LLP; Eric J. Franklin

(57) ABSTRACT

A high voltage bushing including a metal part provided with a resistive layer.

7 Claims, 2 Drawing Sheets

(56) References Cited

OTHER PUBLICATIONS

Polypropylene Material Information From www.goodfellow.com.*
International Search Report—Nov. 29, 2007.
Written Opinion of the International Searching Authority—Nov. 27, 2007.
Notification of The First Office Action from the State Intellectual Property Office of People's Republic of China, dated Aug. 4, 2010, issued in connection with counterpart Chinese Patent Application No. 200710107151.7.
Notification of the Second Office Action from the State Intellectual Property Office of People's Republic of China, dated Mar. 29, 2011, issued in connection with counterpart Chinese Patent Application No. 200710107151.7.
European Search Report—Aug. 23, 2013—Issued in Counterpart Application No. 07808853.1.

* cited by examiner

HIGH VOLTAGE BUSHING

CROSS-REFERENCE TO RELATED APPLICATIONS

This application claims priority to Swedish patent application 0601787-5 filed 31 Aug. 2006 and is the national phase under 35 U.S.C. §371 of PCT/SE2007/050600 filed 30 Aug. 2007.

FIELD OF INVENTION

The present invention relates generally to high voltage bushings and more particularly to a high voltage bushing with improved protection against partial discharges.

BACKGROUND

It is known that electrical equipment and devices, such as high voltage transformers, are usually equipped with bushings, which are suitable to carry current at high potential through a grounded barrier, e.g. a transformer tank or a wall.

Conventional bushings are constituted by an insulator made of ceramic or composite material, which is provided with sheds and is generally hollow. The voltage grading can be obtained with or without a condenser body through which the electrical conductor passes.

An example of a bushing 1 for wall mounting will now be described with reference to FIG. 1 showing the overall structure of the bushing, and FIG. 2 showing a sectional view of the bushing mounted to a wall.

A high voltage conductor 2 extends through the center of a hollow gas filled bushing insulator 4 that forms a housing around the high voltage conductor. A wall flange 6 is provided to connect the housing of the bushing to ground through a wall. The high voltage conductor is provided with a contact 8, 10 in both ends thereof.

A wall 12 is shown in FIG. 2, in which the bushing 1 is mounted by means of the wall flange 6. This figure shows a so-called throat shield or voltage grading shield 14 provided inside the hollow bushing insulator 2 at and around the portion of the bushing going through the wall 12. This shield, which is made of a suitable metal, such as aluminum, accomplishes grading of the electrical field in the bushing and is used instead of a condenser core.

In gas filled high voltage bushings, dust or dirt can become a problem if the dust particles generate partial discharge when hitting a metallic electrode, such as the voltage grading shield.

SUMMARY OF THE INVENTION

An object of the present invention is to provide a gas filled high voltage bushing wherein the risk for partial discharge is reduced compared to prior art bushings.

The invention is based on the realization that highly dielectrically stressed metal parts in a bushing can be provided with a resistive layer, allowing slow and controlled discharge of particles hitting the surface thereof.

According to a first aspect of the invention a high voltage bushing for use with a high voltage device is provided, the high voltage bushing comprising a metal part provided in a gas filled hollow insulator housing and a voltage grading metal shield provided in the insulator housing; the bushing being characterized in that at least a portion of the surface of the metal part is provided with a layer having a resistivity in the range of $10^8$-$10^{14}$ Ωm.

According to a second aspect of the invention a high voltage device comprising such a bushing is provided.

With the inventive bushing, slow and controlled discharge of particles hitting the surface of the metal part is achieved. This in turn reduces or even eliminates partial discharge due to dust or dirt inside the insulator housing of the bushing.

In a preferred embodiment, the resistive layer comprises a polymeric material.

In another preferred embodiment, the resistive layer comprises a ceramic material.

In a further preferred embodiment, the resistive layer is provided on an outer end portion of the metal part, this portion being highly stressed.

BRIEF DESCRIPTION OF DRAWINGS

The invention is now described, by way of example, with reference to the accompanying drawings, in which.

DETAILED DESCRIPTION OF A PREFERRED EMBODIMENT OF THE INVENTION

In the following a detailed description of a preferred embodiment of the present invention will be given. In this description, the term "high voltage" will be used for voltages of 10 kV and higher. Today, the upper limit in commercial high voltage devices is 800 kV but even higher voltages, such as 1000 kV or more, are already built or envisaged in the near future.

Figure 1:
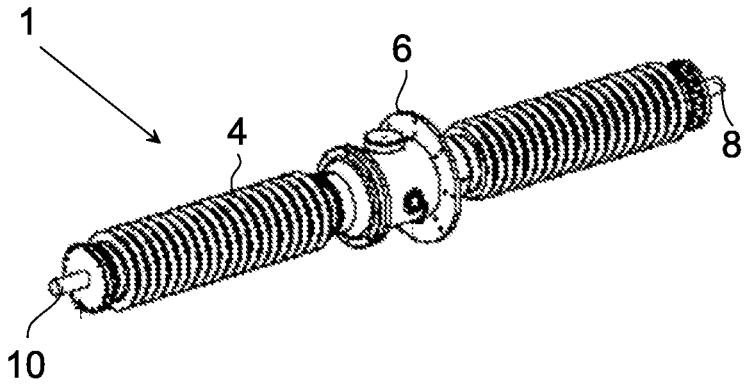
Fig. 1 (Prior art)
FIG. 1 is an overall view of a prior art high voltage bushing.
Figure 2:
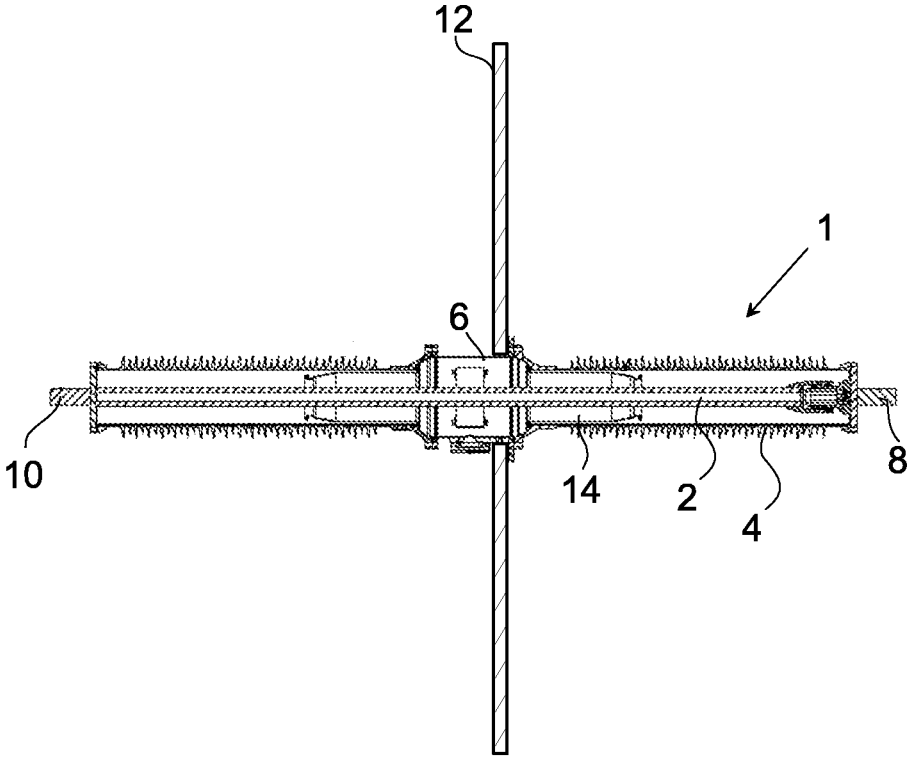
Fig. 2 (Prior art)
FIG. 2 is a sectional view of the bushing of FIG. 1 mounted extending through a wall.
Figure 3:
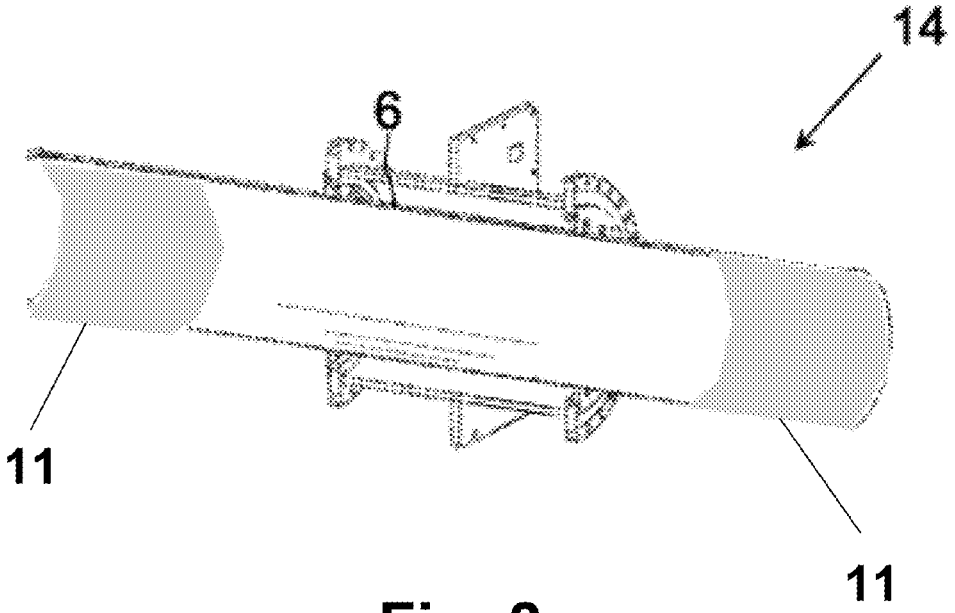
FIG. 3 is a partially cut-away view of a voltage grading shield and a wall flange of a bushing according to the invention.

The present invention is applicable to the general description of the high voltage bushing given in the background section with reference to FIGS. 1 and 2 and reference will in the following be made to these figures. However, reference will now be made to FIG. 3, showing a partially cut-away perspective view of a metal part in the form of a voltage grading shield 14, including a wall flange 6.

The voltage grading shield 14 is essentially cylindrical. The main portion of the shield 14 is made of some suitable metal, such as aluminum. A resistive layer is provided at least on a portion of the surface of the shield, preferably on highly dielectrically stressed surfaces, such as at the end portions of the voltage grading shield. By "resistive" is in this context be construed a layer 11 having a controlled resistivity between $10^8$-$10^{14}$ Ωm allowing slow and moderate discharge of particles hitting the surface thereof. In one embodiment, the resistive layer comprises a ceramic material including aluminum oxide. If the resistive layer comprises aluminum oxide, this layer is preferably created by anodizing aluminum to a thickness of 10-1000 μm.

In another embodiment, the resistive layer comprises a polymeric base material, such as epoxy, polyurethane, or Teflon. This base material can be filled or unfilled.

The resistive layer preferably has a thickness of 10-1000 μm.

A preferred embodiment of a high voltage bushing has been described. A person skilled in the art realizes that this could be varied within the scope of the appended claims. Thus, although the metal part provided with a resistive layer has been described as a voltage grading shield, it is realized that other metal parts in the hollow insulator housing of a bushing, such as flanges or conductors, also fall within the definition of metal part.

Although the bushing according to the invention has been described mounted through a wall, is will be appreciated that bushings for assembly to a high voltage device, such as a transformer, reactor, breaker, generator, or other device finding an application in high voltage systems are also covered by the inventive idea.

The invention claimed is:

1. A high voltage bushing comprising:

a high voltage conductor provided in a gas filled hollow insulator housing;

a voltage grading shield comprising a cylindrical metal part provided in the insulator housing, surrounding and extending along the high voltage conductor, and a layer having a resistivity in a range of $10^8$-$10^{14}$ Ωm provided only on a surface of lengthwise end portions of the metal part, wherein the layer has a thickness in a range of 10-1000 μm, the layer permitting slow and controlled partial discharge of particles hitting a surface of the layer, wherein the layer comprises aluminum oxide.

2. A high voltage bushing comprising:

a high voltage conductor provided in a gas filled hollow insulator housing;

a voltage grading shield comprising a cylindrical metal part provided in the insulator housing, surrounding and extending along the high voltage conductor, and a layer having a resistivity in a range of $10^8$-$10^{14}$ Ωm provided only on a surface of lengthwise end portions of the metal part, wherein the layer has a thickness in a range of 10-1000 μm, the layer permitting slow and controlled partial discharge of particles hitting a surface of the layer, wherein the layer comprises a ceramic material.

3. A high voltage bushing comprising:

a high voltage conductor provided in a gas filled hollow insulator housing;

a voltage grading shield comprising a cylindrical metal part provided in the insulator housing, surrounding and extending along the high voltage conductor, and a layer having a resistivity in a range of $10^8$-$10^{14}$ Ωm provided only on a surface of lengthwise end portions of the metal part, wherein the layer has a thickness in a range of 10-1000 μm, the layer permitting slow and controlled partial discharge of particles hitting a surface of the layer, wherein the layer comprises a polymeric base material that is any of epoxy, polyurethane, and Teflon.

4. A high voltage device, comprising:

a high voltage bushing comprising a high voltage conductor provided in a gas filled hollow insulator housing, a cylindrical metal part provided in the insulator housing, surrounding and extending along the high voltage conductor, a layer having a resistivity in a range of $10^8$-$10^{14}$ Ωm provided only on a surface of lengthwise end portions of the metal part, wherein the layer has a thickness in a range of 10-1000 μm, the layer permitting slow and controlled partial discharge of particles hitting a surface of the layer, wherein the layer comprises aluminum oxide.

5. The high voltage bushing according to claim 1, wherein the voltage grading shield comprises aluminum and the layer comprises anodized aluminum.

6. A high voltage device, comprising:

a high voltage bushing comprising a high voltage conductor provided in a gas filled hollow insulator housing, a cylindrical metal part provided in the insulator housing, surrounding and extending along the high voltage conductor, a layer having a resistivity in a range of $10^8$-$10^{14}$ Ωm provided only on a surface of lengthwise end portions of the metal part, wherein the layer has a thickness in a range of 10-1000 μm, the layer permitting slow and controlled partial discharge of particles hitting a surface of the layer, wherein the layer comprises a ceramic material.

7. A high voltage device, comprising:

a high voltage bushing comprising a high voltage conductor provided in a gas filled hollow insulator housing, a cylindrical metal part provided in the insulator housing, surrounding and extending along the high voltage conductor, a layer having a resistivity in a range of $10^8$-$10^{14}$ Ωm provided only on a surface of lengthwise end portions of the metal part, wherein the layer has a thickness in a range of 10-1000 μm, the layer permitting slow and controlled partial discharge of particles hitting a surface of the layer, wherein the layer comprises a polymeric base material that is any of epoxy, polyurethane, and Teflon.

* * * * *